US009591927B2

(12) United States Patent
Glöckl

(10) Patent No.: US 9,591,927 B2
(45) Date of Patent: Mar. 14, 2017

(54) STANDING SEAT

(75) Inventor: Josef Glöckl, Kirchheim (DE)

(73) Assignee: AERIS GMBH, Haar (DE)

( * ) Notice: Subject to any disclaimer, the term of this patent is extended or adjusted under 35 U.S.C. 154(b) by 123 days.

(21) Appl. No.: 13/500,133

(22) PCT Filed: Jul. 29, 2010

(86) PCT No.: PCT/EP2010/061010

§ 371 (c)(1),
(2), (4) Date: May 14, 2012

(87) PCT Pub. No.: WO2011/047896

PCT Pub. Date: Apr. 28, 2011

(65) Prior Publication Data

US 2012/0217771 A1 Aug. 30, 2012

(30) Foreign Application Priority Data

Oct. 23, 2009 (DE) ..... 20 2009 014 380 U

(51) Int. Cl.
*A47C 9/00* (2006.01)
*A47C 9/02* (2006.01)

(52) U.S. Cl.
CPC ..... *A47C 9/025* (2013.01)

(58) Field of Classification Search
CPC ..... A47C 3/0255; A47C 1/022; A47C 9/025
USPC ..... 297/183.1, 261.1, 261.2, 284.11, 344.12
See application file for complete search history.

(56) References Cited

U.S. PATENT DOCUMENTS

| | | | | |
|---|---|---|---|---|
| 5,435,623 | A * | 7/1995 | Kapec et al. | 297/339 |
| 5,447,358 | A * | 9/1995 | Corlett | 297/344.18 |
| 7,331,305 | B2 * | 2/2008 | Garelick | 114/363 |
| 2003/0164633 | A1 * | 9/2003 | Jakus et al. | 297/271.5 |
| 2010/0164259 | A1 * | 7/2010 | Bellvis Castillo et al. | 297/195.11 |

FOREIGN PATENT DOCUMENTS

| | | | |
|---|---|---|---|
| DE | 10 2006 050 394 A1 | | 4/2008 |
| WO | WO2008034529 | * | 3/2008 |
| WO | WO 2011/047896 A1 | | 4/2011 |

OTHER PUBLICATIONS

Preliminary Search Report and Written Opinion for related International Patent Application No. PCT/EP2010/061010; report dated Nov. 25, 2010.

* cited by examiner

*Primary Examiner* — Philip Gabler
(74) *Attorney, Agent, or Firm* — Miller, Matthias & Hull LLP

(57) ABSTRACT

A seat comprising a seat support for receiving and bracing a seat plate, which comprises a rear region and a front region, the rear region, which receives the ischial bones (os ischii), being arranged lower than the front region and the seat support supporting the rear region, wherein the front region of the seat plate is formed resiliently as a flexible zone without direct supports.

8 Claims, 7 Drawing Sheets

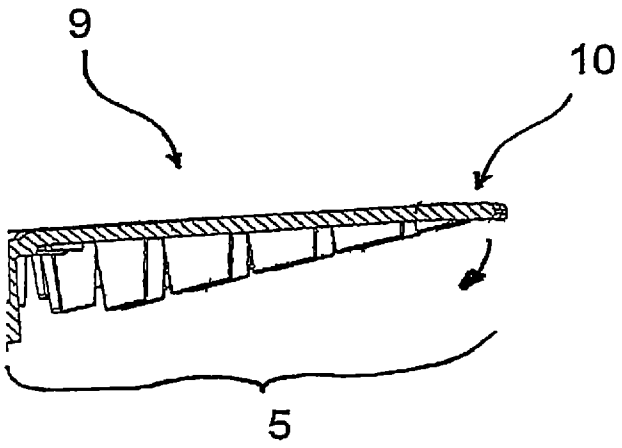
Fig. 1b
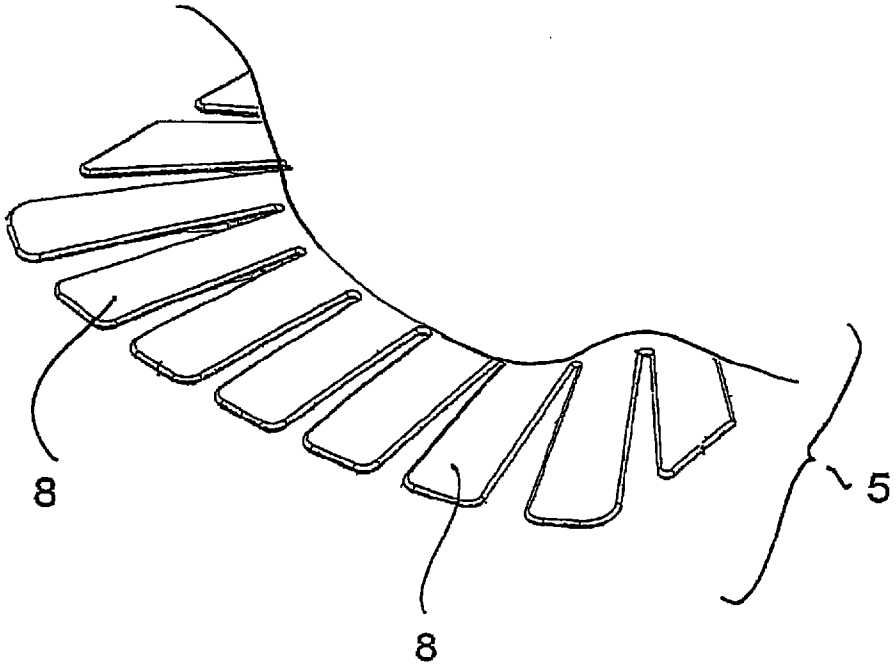

STANDING SEAT

CROSS-REFERENCE TO RELATED APPLICATIONS

This application is a US national stage filing under 35 USC §371 of International Patent Application No. PCT/EP2010/06100 filed on Jul. 29, 2010, and claims priority under the Paris Convention to German Patent Application No. 20 2009 014 380.5 filed on Oct. 23, 2009.

FIELD OF THE DISCLOSURE

The invention relates to a seat comprising a seat support for receiving and bracing a seat plate, which comprises at least a rear region and a front region, the rear region, which receives the ischial bones (os ischii), being arranged lower than the front region, the seat support supporting the rear region.

BACKGROUND OF THE DISCLOSURE

DE 10 2006 050 394 A1 discloses a seat comprising a seat support and a planar seat plate which is arranged thereon. Apart from the central underside region, the entire seat is enclosed by a foam covering. This covering is formed as a relatively thick, upwardly curved seat cushion in the upper seat region, and further extends on the underside of the seat support as a relatively thin layer.

The seat support is arranged on a height-adjustable column, which is arranged inclined forwards by an angle and received in an articulated manner in a bearing inside a foot part. In the upper region, the foot part comprises an opening, inside which the column can be moved in all directions. Rubber pimples are arranged on the underside of the foot part to prevent the foot part from slipping away on a flat surface.

In the disclosed construction, it has been found to be a drawback in everyday use that the configuration of the seat is unpleasantly, hard on the user of the seat. As a result, he continuously changes his sitting position. The user therefore feels uncomfortable on a seat of this type, and changes it for a conventional chair or seat, rejecting a seat construction which prevents the physiologically disadvantageous effects of conventional seats.

SUMMARY OF THE DISCLOSURE

The object of the invention is therefore to provide a seat which overcomes the physiological drawbacks of conventional seats, but is also pleasant to sit on and gentle on the ischial tuberosity.

The object is achieved by a seat having the features of claim 1.

The seat according to the invention comprises a seat support for receiving and bracing a seat plate, which comprises at least a rear region and a front region, the rear region, which receives the ischial bones (os ischii), being arranged lower than the front region, the seat support supporting the rear region, and the front region of the seat plate being formed resiliently as a flexible zone without direct supports.

This configuration provides an optimum seat, which overcomes the aforementioned drawbacks. Forming two regions of differing height makes it easy for the seat user to change his sitting position via his ischial tuberosities.

To improve leg circulation, it is advantageous to form a transition region extending substantially continuously between the two regions and a flexible zone on the seat plate in the front region. In this way, pain from a seat edge pressing into the thigh can be prevented.

Advantageously, the flexible zone is in the form of a cantilever. This provides a simple, cost-effective and reliable construction in which it is possible for the front region to move.

To prevent damage to the seat, it is advantageous to restrict the flexing of the flexible zone or front region. For this purpose, at least one support brace may be provided on the seat plate or the seat support, substantially between the transition region and the flexible zone. In an advantageous configuration, the support brace is formed on the seat plate or on the seat support in a construction such that the seat plate or the seat support can be manufactured in a simple manner by injection moulding.

Advantageously, a resilient material is arranged between the at least one support brace and the flexible zone. This relieves the load on the support brace, while also acting as a cushioning means to restrict the movement, i.e. to prevent the flexible zone from springing back into the rest position thereof.

To provide dissipation of the forces acting on the support brace, it is advantageous to brace the support brace on a seat cover and/or on the seat support. In this way, the construction can dissipate the introduced forces to an underframe, on which the seat may be arranged.

To increase the comfort of the flexible zone, it is advantageous for it to comprise radially arranged lamellar arms, which are formed so as to increase in softness radially from the inside to the outside. In this way, different sub-regions having different spring deflection paths can be provided on the periphery of the seat in the front region.

For mechanical stability of the arrangement consisting of the seat brace and the flexible zone, it is advantageous for the two of them substantially to form a V together, which is open towards the edge region. This provides a flexible arrangement, which achieves the purpose thereof as regards spring deflection or transmission but is not broken under the effect of large forces.

To increase the mechanical loading capacity, it is further advantageous for the seat plate, the seat support and the seat cover to be interconnected in the rear region. As a result of the connection, the exerted forces can be transmitted from one region to the other, resulting in the overall exerted force being distributed to all of the parts. The individual parts can thus be made more breakproof.

In a preferred configuration, the seat cover comprises a handle, the seat cover being positioned substantially in a positive fit on the seat support and the seat support comprising on the underside a hub having a receiving cone for an underframe. The positive fit between the seat support and seat cover again increases the mechanical stability. The handle makes it easier to change the position of the seat or to arrange the seat.

In a further advantageous configuration, the seat may be arranged on an underframe, in particular in the form of a column, and on a foot part, an arrangement, in particular a pendulum joint, which makes possible a pendulum movement of the seated person being formed in the underframe and/or between the underframe and the foot part and/or in the foot part. A seat having at least two regions of different height is particularly adapted for an arrangement adapted for pendulum movements, since pendulum movements can be carried out easily when the ischial tuberosities are positioned in the region of a lower-lying rear region. This is due to the engagement of the ischial tuberosities in the lower-lying region. This provides secure contact between the ischial tuberosities and the seat.

It is further advantageous for the pendulum joint to comprise on the upper side a circular flange, a conical mounting, and a substantially rectangular plate which is arranged in a base region and comprises a recess, a rubber member being arranged between the flange and the plate. The pendulum joint can thus be inclined in all directions from a vertical axis. This inclination is made possible by the rubber member, which may also be formed so as to restrict the pendulum movement range of the column and the seat.

It is further advantageous for the underframe in the form of a column to extend through the recess. In this way, the column can easily be braced on the floor.

In this case, it is advantageous for the underframe in the form of a column to be a gas compression spring. In this way, the height of the seat can be adjusted easily.

The recess is preferably formed in a positive fit with the column with play. In this way, the pendulum movement range can be restricted using the recess.

This restriction may also be formed only for particular directions, by forming the recess as a slot so as to make the pendulum movement possible in one direction.

For seat arrangements in which the pendulum movement range is set too large, a restriction member which restricts the pendulum movement range of the column may be arranged on the plate arranged in the base region.

The restriction member advantageously comprises a recess in a positive fit with the column with play. It may also be provided with a recess in the form of a slot so as to make the pendulum movement possible in one direction.

In a further advantageous configuration, the foot part comprises a rubber strip on the underside at the edge. In this way, if the pendulum movement range is exceeded and the foot part is tilted as a result, the risk of injury can be eliminated, since it is no longer possible for the foot part to slip in some positions, as is known from the state of the art.

Because it is easy to move the seat by means of the regions of different height, it is advantageous for a device which limits and/or impedes a pendulum movement of the seated person to be formed on the foot part. This can prevent users of the seat, who are not expecting a movement of a pendulating seat, from being startled.

In this case, it is advantageous for the device on the foot part to be in the form of a plate. In this way, the movement of the column of a pendulating underframe can be restricted in a simple manner.

In an advantageous configuration of the device, it comprises a recess in which the column, in particular as a configuration of a gas spring, may be used.

To limit the pendulum movement of the column, it is advantageous for the recess to be formed in a positive fit with the column. In this way, the pendulum movement can be slightly restricted by the configuration of the recess. Further, in this way it is also possible to restrict the pendulum behaviour of pre-existing pendulating seat arrangements.

So as to make a pendulum movement possible in a particular direction, for example, it is advantageous to form the recess as a slot. In this way, a pendulum movement can be made possible in one direction in which unexpected tilting of the seat is not liable to occur.

To make a pendulating seat easier to use, it may advantageously be provided with a rubber strip on the underside at the edge of the foot part.

In an advantageous configuration of the seat plate, it is advantageous for it to comprise at least one cushion. The at least one cushion may be arranged above and/or below the seat plate. In this way, on the one hand a uniform shape for the seat may be provided, and on the other hand the seat may be cushioned so as to be pleasant for the user.

In an advantageous configuration, the cushion is formed from a flexible foam and/or an integral foam. Because the two types of foam are of different hardnesses, the way the user will wish to sit on different parts of the seat can be taken into account.

Advantageous configurations and features may be taken from the following description of embodiments, which are explained in connection with the drawings.

BRIEF DESCRIPTION OF THE FIGURES

In the drawings:

FIG. 1*b* shows a plan view and a side view of a configuration of the resilience in the front region.

DETAILED DESCRIPTION OF THE DISCLOSURE

Figure 1A:
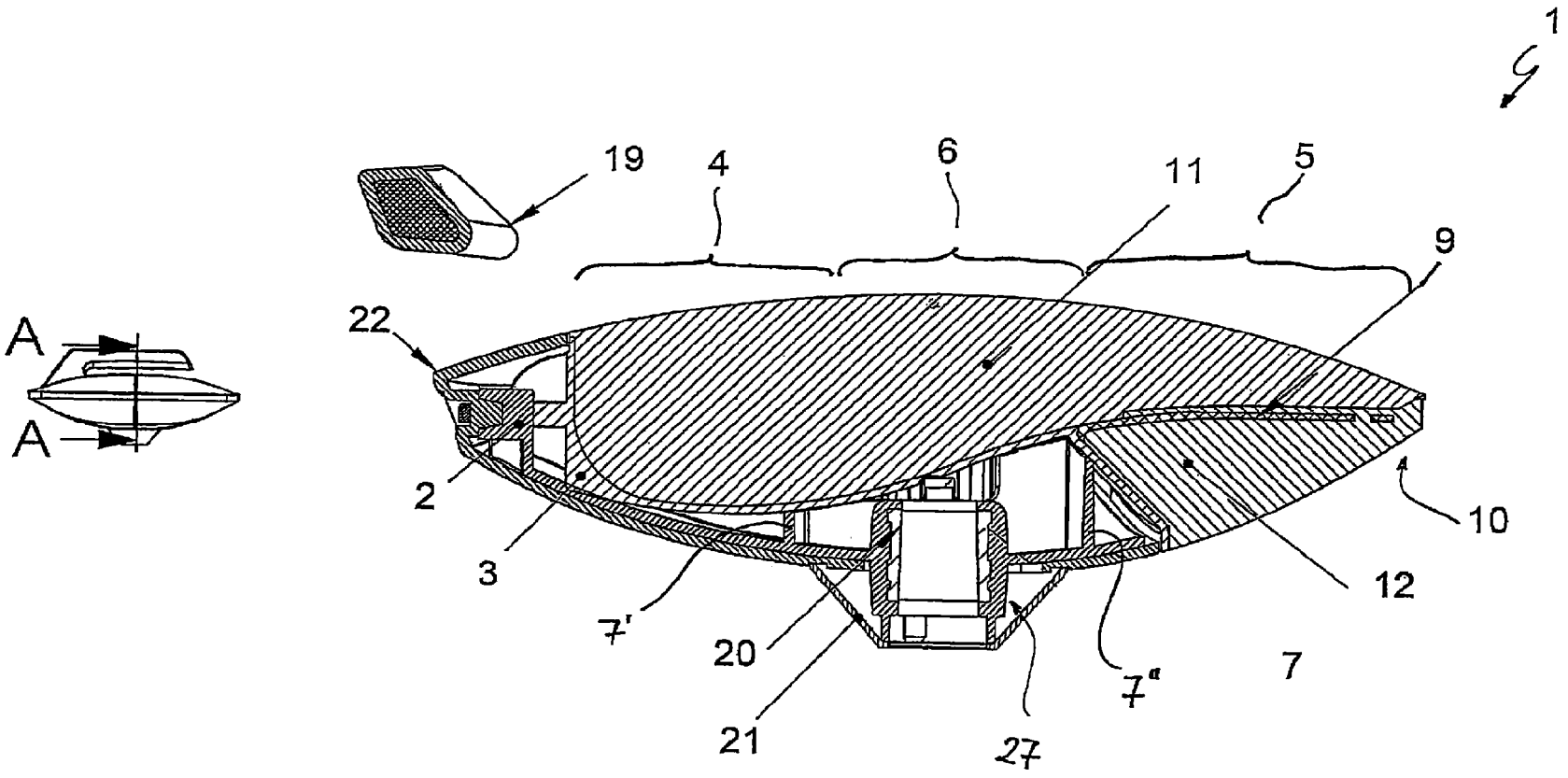
FIG. 1*a* is a side view of the seat.

FIG. 1*a* is a sectional side view of a seat 1. The seat 1 mainly consists of a cushion 11, 12, which is formed with foam and arranged both above and below a seat plate 3. The cushions are connected to the seat plate 3 by fixing means such as adhesives, and are positioned flush on the seat plate 3.

The seat plate 3 follows a curved path having two regions of different height, in which a rear region 4, which receives the sitting bones, is arranged lower than a front region 5 for receiving the thighs.

Forming two regions of different height makes it easier for the seat user to use his ischial tuberosities to change the seat position. This can be done easily because the shape of the seat with the regions of different height means that the ischial tuberosities engage in a low region such as the rear region 4 and can thus interact therewith. This provides that the seat can follow small changes in the user's pelvis. Since the front region of the seat plate is configured resiliently without direct supports, the seat plate can be made resilient in this region. This guarantees optimum blood supply to the legs in any sitting position, and this can prevent the feet from going to sleep.

The seat plate 3 is received by a seat support 2 and mechanically braced by support braces 7', 7" in the transition region 6 and in the rear region. The front region 5, by contrast, is configured resiliently as a flexible zone 9 without direct supports, so as to be able to move.

The configuration of the flexible zone 9 as a cantilever promotes the ability of the front region 5 at the edge region 10 to deflect on one side, the deflection of the flexible zone or front region being restricted by a support brace 7. Said brace is arranged substantially on the underside of the front region 5 of the seat plate 3 between the transition region 6 and the flexible zone 9. The support brace 7 thus extends obliquely forwards towards the edge region 10. It is further formed in one piece with the seat plate 3, and the seat plate 3 can therefore be manufactured together with the support brace 7 by injection moulding.

On the one hand, a support brace 7 of this type does restrict the movement of the front region 4, but on the other hand, it prevents folding up, and as a result the size of the seat surface is maintained and thus remains usable. Forming the support brace on the plate 3 or the support 2 means that mounting work can be reduced and assembly can be made easier.

An integral foam is arranged between the support brace 7 and the front region 5 of the seat plate 3, and transmits the resilient movements of the flexible zone 9 to the support brace 7. The support brace 7 passes the forces from the resilient movement on to the seat cover 22, which restricts the deflection of the brace, i.e. acts as a stop. The stop limits the freedom of movement of the support brace 7, in such a way that the positioning thereof can be used to adjust the resilient path.

The support brace 7 and the flexible zone 9 together substantially form a V, which is open towards the edge region 10. The support brace can thus compress resiliently so as not to break off if the seat user is rocking. The support brace 7" further supports the brace 7, again so as to restrict the deflection thereof and increase the stability of the arrangement as a whole.

Centrally below the seat 1, a hub 27 having a receiving cone for an underframe is arranged on the seat support 2. Inside the hub 27 there is a conical socket 20, which provides contact in a positive and frictional fit with a column 13 (not shown).

A cone cover 21 is arranged below the conical socket 20, and covers fixing screws which connect the seat support 2 to the seat cover 22.

In the transition region 6 and the rear region 4, the seat cover 22 is positioned substantially in a positive fit on the seat carrier 2, the seat carrier 2 being in contact with the seat plate 3 via the support braces 7', 7".

The seat cover 22 has a handle 19, with which the seat can easily be transported to another location. In this case, the handle 19 or the seat cover is connected not only to the seat support 2, as disclosed above, but also to the seat plate 3. All the parts of the seat 1 in the rear region 4 are thus interconnected. The forces exerted on the seat by the handle or by the weight of the user can be dissipated to the hub 27, which is arranged on the underside and has a receiving cone, which is arranged on the seat support 2 and passes the forces on to the underframe.

FIG. 1*b* shows a top view of the front region 5 or the flexible zone 9. In this case, the zone 9 comprises radially arranged lamellar arms 8, which are formed so as to increase in softness radially from the inside to the outside. The lamellar arms are of the same width in the example shown, but different shapes and sizes are also possible. The lamellar arms 8 can prevent the seat plate edge from pressing into the thigh, even when weight is shifted from one foot to the other. This gives the seat a pleasant feel during movements on the seat, encouraging movements while seated. Further, interference with circulation to the legs is reliably prevented in the various positions. If the seat is applied to a height-adjustable underframe, this configuration is particularly advantageous for high seat positions, since the edge region of the front region is prevented from pressing into the underside of the user's thigh.

FIG. 1*b* further shows an alternative configuration of the flexible zone 9 in the front region 5, stabilising members being arranged on the underside of the lamellae. The stabilising members consist of individual ribs, spaced apart by V-shaped breaks. During flexing as shown by the arrow, the width of the breaks between the ribs decreases, until the opposing surfaces are positioned against one another, preventing further flexing of the lamellar arms.

Alternatively, it is also possible to form the breaks in different shapes and with different opening widths, it being possible to provide different flexibilities, an inverted V-shaped form being preferred.

Figure 2:
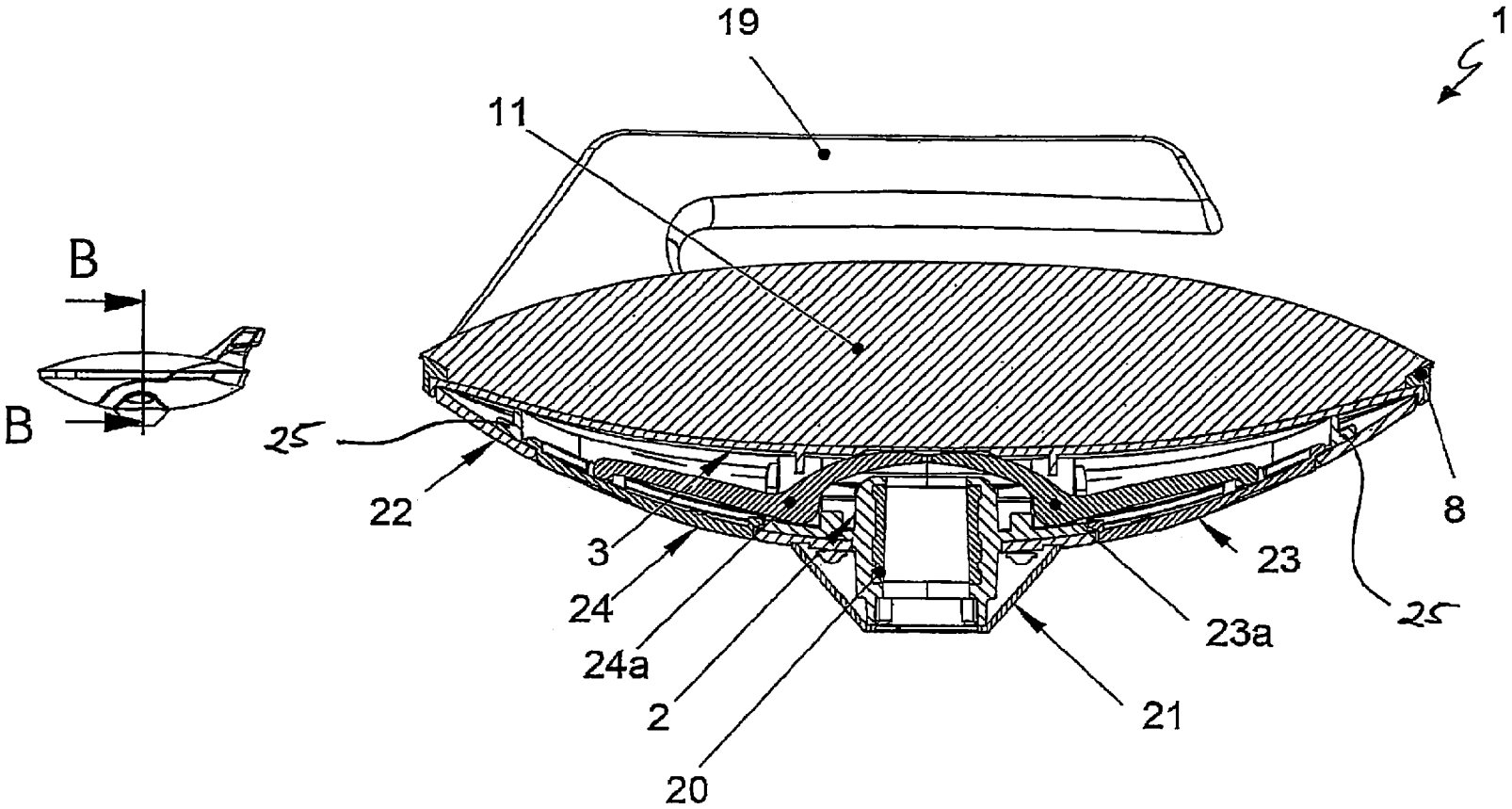
FIG. 2 is a front sectional view of the seat.

FIG. 2 is a front sectional view of the seat 1, showing the release mechanism for adjusting the height of the seat.

The release mechanism has a respective left actuator 23 and right actuator 24, which act via levers 23*a*, 24*a* on a gas compression spring (not shown) so as to determine the height deflection thereof. The gas compression spring is arranged in the conical socket 20 and thus rigidly connected to the seat support 2 or the hub.

The release mechanism is in this case arranged in recesses provided inside the seat support 2, the individual components being arranged positioned freely in the recesses thereof.

FIG. 2 further shows that support webs 25 are introduced between the seat plate 3 and the seat cover 22.

Figure 3:
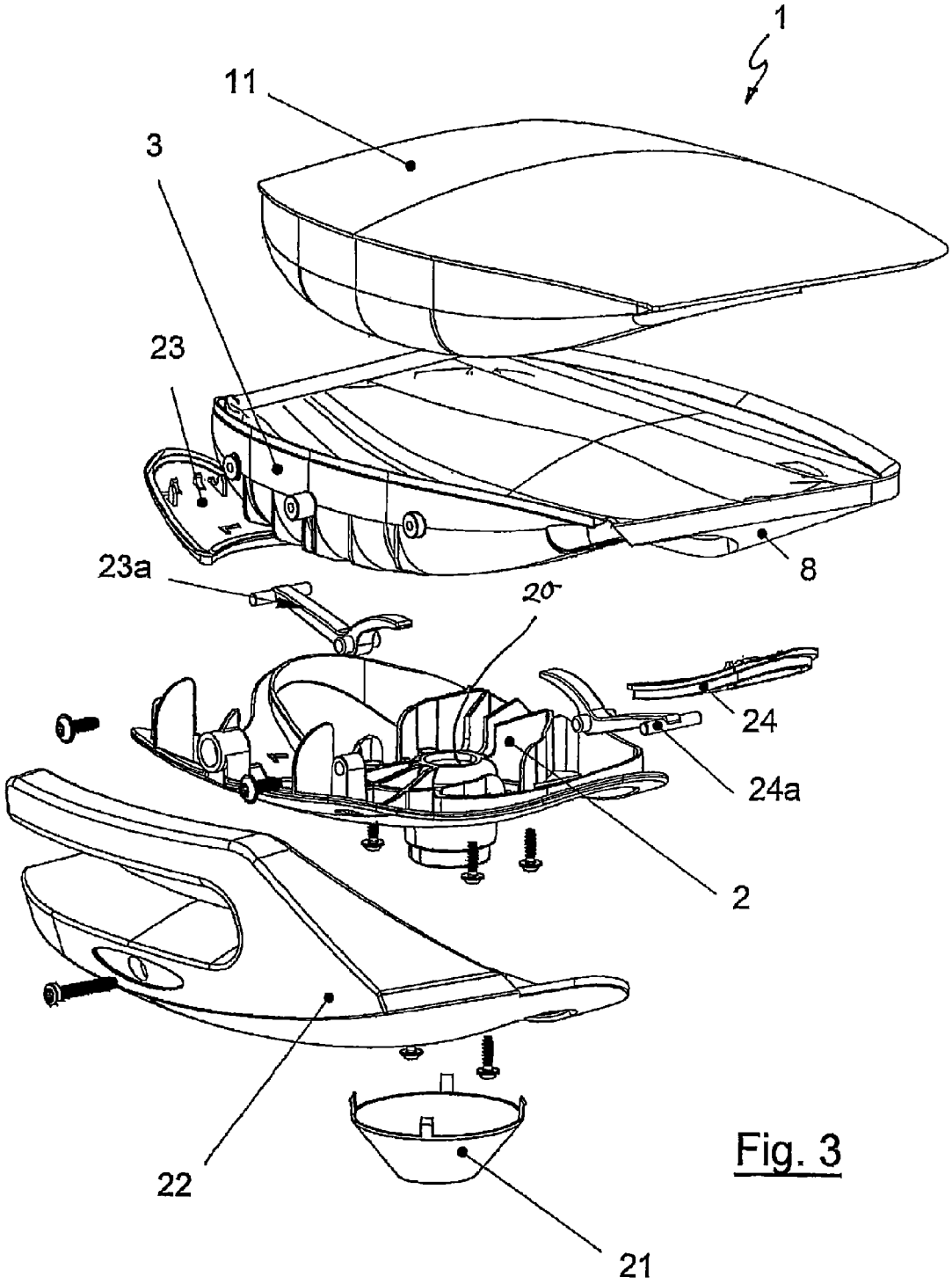
FIG. 3 is an exploded view of the seat according to the invention.

FIG. 3 is an exploded view of the seat, the cushion 11 being fixed to the seat plate 3 by adhesive. After the insertion of the levers 23*a* and 24*a* and the actuators 23 and 24 for releasing the gas compression spring, the seat plate 3 is arranged on the seat support 2 and fixed by means of fixing screws. Subsequently, the construction consisting of the cushion 11, the seat plate 3, the seat support 2 and the associated mechanisms (actuators and levers) is connected to the seat cover 22 by screws. The connecting screws, which are applied to the seat cover, are covered by the cone cover 21 in the region of the conical socket 20. In this case, the cone cover 21 comprises four tabs, which can snap into associated recesses on the seat cover.

Figure 4:
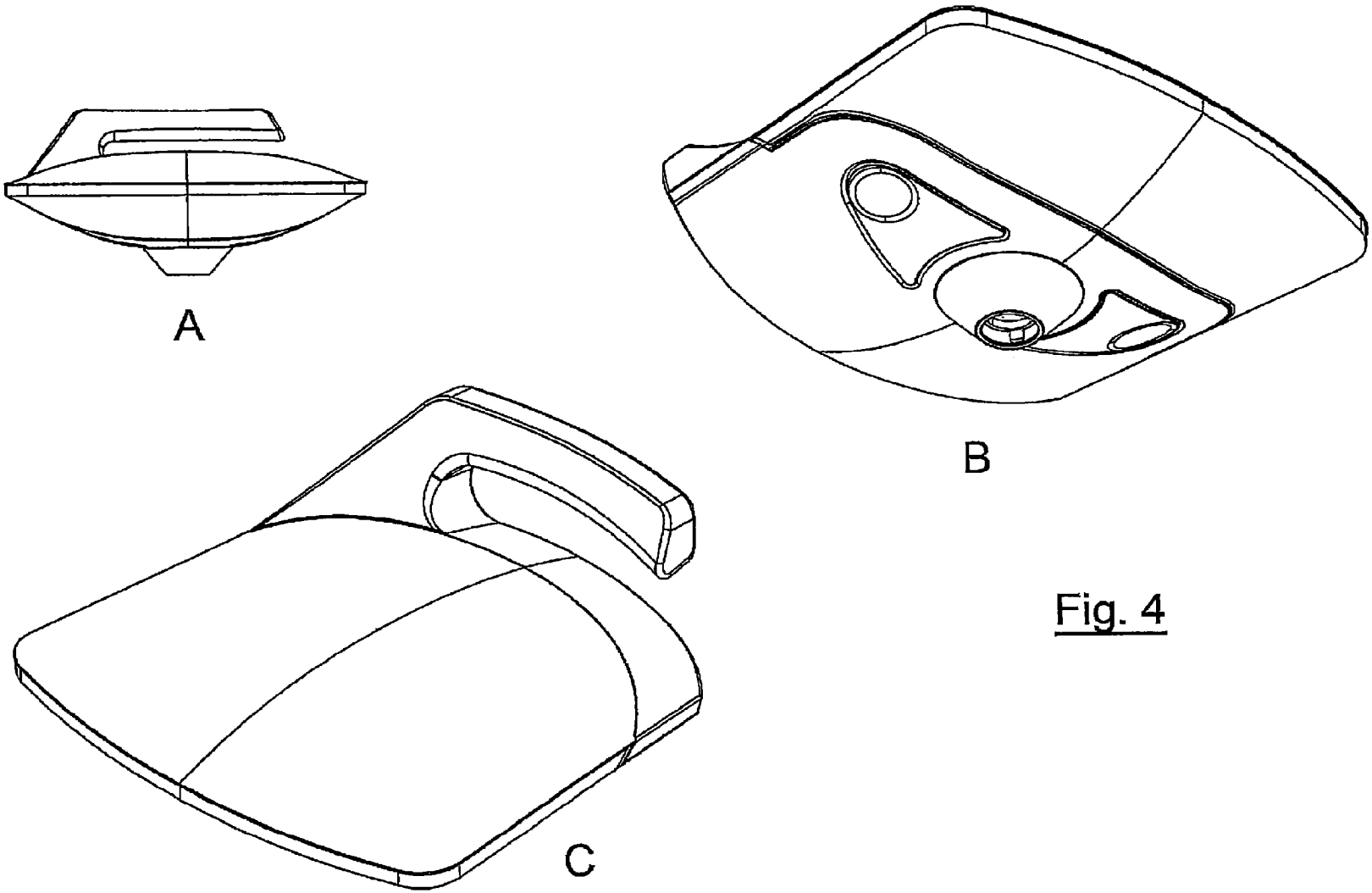
FIG. 4 shows a plan view, a view from below and a front view of a seat.

FIG. 4 shows the assembled seat, consisting of the components described in FIG. 3, in various views, including a front view A, a view D from below and a plan view C.

Figure 5:
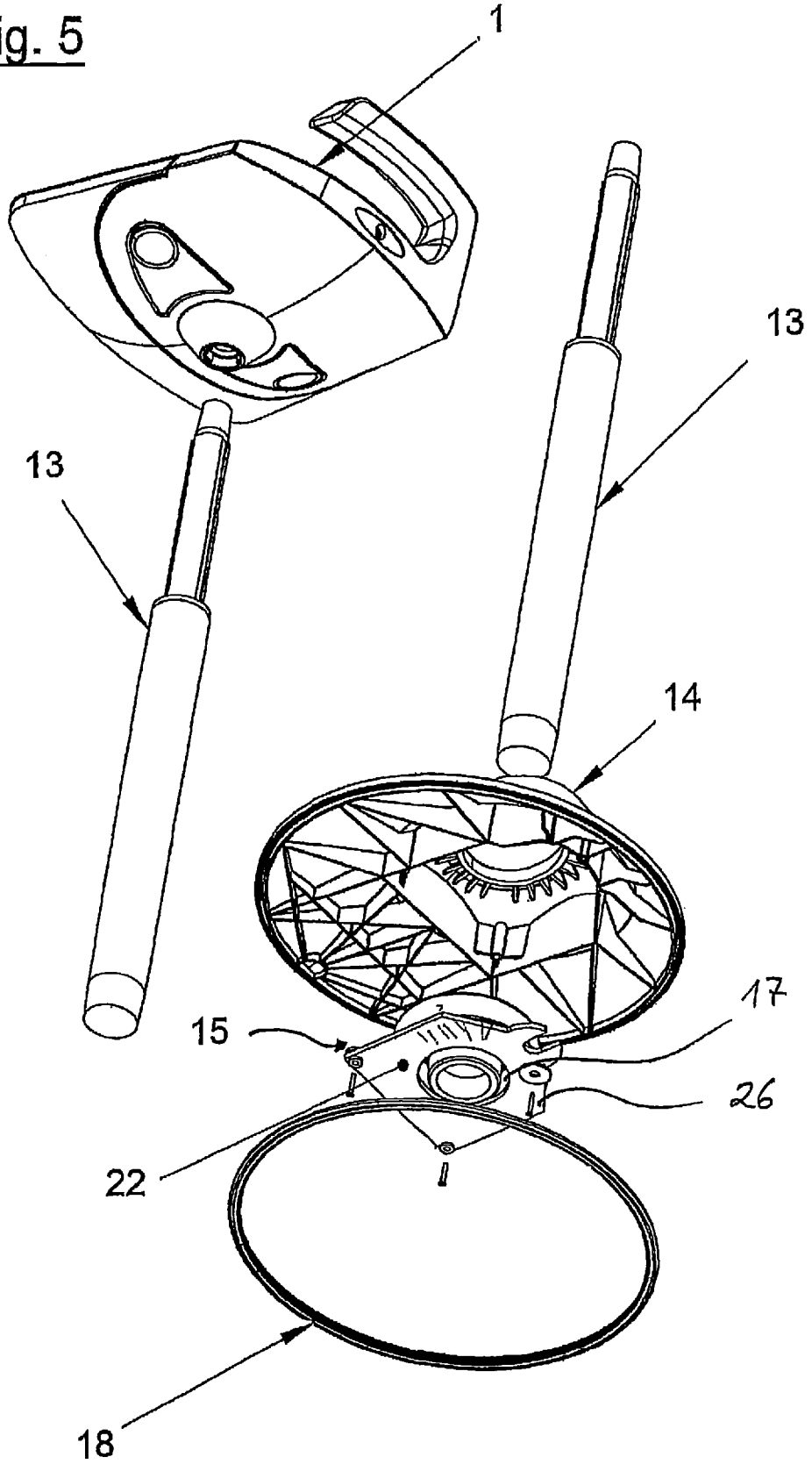
FIG. 5 is an exploded view of an underframe comprising a foot part.

FIG. 5 is an exploded view of the seat on an underframe, in particular in the form of a column 13, and on a foot part 14, a pendulum joint 15 being arranged in the foot part 14 and making a pendulum movement of a seated person possible.

In the central region, the column 13 extends through the foot part 14 as far as a substantially rectangular plate 26. The plate 26 is provided with a recess 17, through which the column 13 extends. In this case, the recess 17 is formed in a positive fit with the column 13 with play, in such a way that the pendulum movement range or ability to pendulate of the column 13 is limited or completely restricted.

Further, to secure the foot part 14 against slipping away on a smooth floor, a rubber strip 18 is arranged on the underside at the edge.

Figure 6:
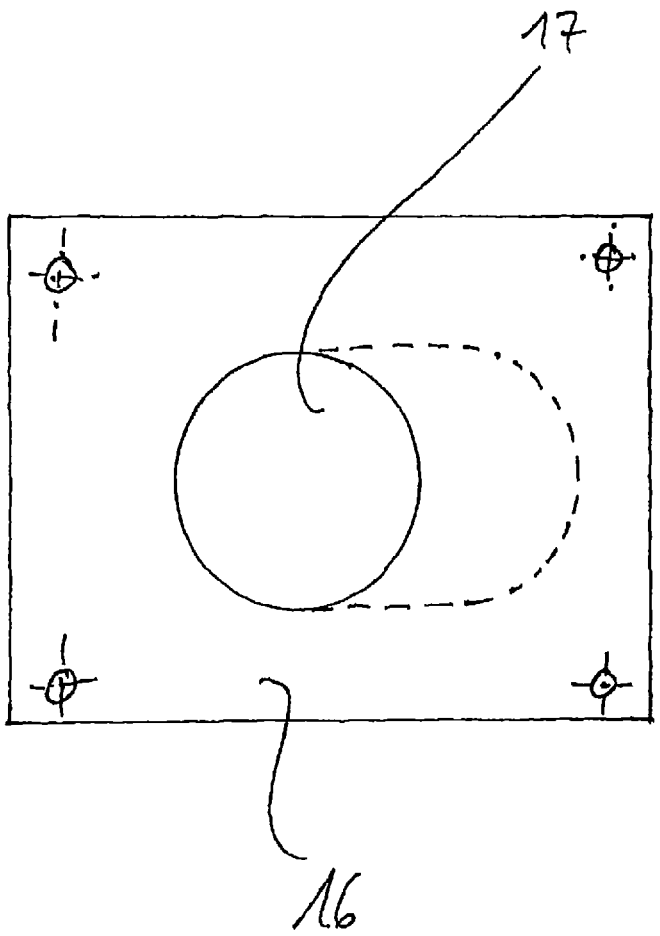
FIG. 6 shows a variant configuration of a device for restricting the pendulum movement on the underside on the foot part.

In FIG. 6, the recess 17 is formed as a slot so as to make the pendulum movement possible in one direction. Thus, this recess is also formed in a positive fit with play, so as to block the undesired pendulum directions. It is also possible to apply a plate, arranged in the base region, as a restriction member to a seat which pendulates in all directions, in such a way that the pendulum movement range of the column 13 can be restricted. This recess too may have play in a positive fit with the column. Further, in this case too a recess in the form of a slot is possible so as to make the pendulum movement possible in one direction.

The configuration of the invention is not limited to the aforementioned preferred embodiments. Rather, a number of variants are conceivable, and still make use of the described solutions, even if the configurations are fundamentally different. Thus, for example, it is within the scope of the disclosed invention to change the shape of the plate or to route the contour of the seat support 2, seat plate 3 and/or seat cover 22 to a different path.

The invention claimed is:

1. A seat comprising:

a seat support;

a contoured seat plate received and braced by the seat support;

a curved rear region adapted to receive the ischial bones (os ischii) formed in the contoured seat plate and supported by the seat support;

a resiliently flexible, curved front region formed in the contoured seat plate, vertically offset from the curved rear region, arranged more vertically distant with respect to the seat support than the curved rear region, and indirectly supported, the front region formed resiliently as a flexible zone;

a slanting transition region formed in the contoured seat plate, extending substantially continuously between the curved rear region and the curved front region, and traversing the differing vertical arrangements of the curved rear region and the curved front region with respect to the seat support so as to form a continuous curve through the curved front, curved rear, and slating transition regions in a vertical plane; and a plurality of flexible lamellar arms formed in the curved front region, radiating substantially from the slanting transition region and increasing in compliance radially from the transition region.

2. The seat according to claim 1, wherein the flexible zone forms a cantilever.

3. The seat according to claim 1, wherein a support brace is provided on the seat plate or the seat support, substantially between the transition region and the flexible zone.

4. The seat according to claim 3, wherein a resilient material is positioned between the support brace and the flexible zone.

5. The seat according to claim 4, wherein the support brace is braced on a seat cover, the seat support, or the seat cover and the seat support.

6. The seat according to claim 3, wherein the support brace and the flexible zone substantially form a V-shape together, which opens towards the curved front region.

7. The seat according to claim 1, wherein the seat plate, the seat support and a seat cover are formed from the same part in the curved rear region.

8. The seat according to claim 1, wherein a seat cover includes a handle, the seat cover and the seat support are formed from the same part, and the seat support includes a hub having a receiving cone for an underframe.

* * * * *